United States Patent [19]

Kiucihi et al.

[11] 4,325,893

[45] Apr. 20, 1982

[54] FUEL SUPPLY SYSTEM FOR INTERNAL COMBUSTION ENGINE

[75] Inventors: Hideo Kiucihi, Aichi; Oyuki Ogawa, Okazaki; Nobuyuki Kobayashi, Toyota, all of Japan

[73] Assignees: Nippondenso Co., Ltd., Kariya; Toyota Jidosha Kogyo Kabushiki Kaisha, Toyota, both of Japan

[21] Appl. No.: 161,570

[22] Filed: Jun. 20, 1980

[30] Foreign Application Priority Data

Jun. 22, 1979 [JP] Japan ..... 54-79541

[51] Int. Cl.[3] ..... F02M 7/22

[52] U.S. Cl. ..... 261/50 A; 261/36 A

[58] Field of Search ..... 261/50 A

[56] References Cited

U.S. PATENT DOCUMENTS

| | | | |
|---|---|---|---|
| 3,967,608 | 7/1976 | Mennesson | 261/50 A |
| 4,143,102 | 3/1979 | Muller et al. | 261/50 A |
| 4,200,074 | 4/1980 | Kosuda et al. | 261/50 A |
| 4,212,277 | 7/1980 | Melotti | 261/50 A |
| 4,212,834 | 7/1980 | Holzbaur | 261/44 G |
| 4,230,083 | 10/1980 | Wessel et al. | 261/50 A |

*Primary Examiner*—Tim R. Miles

*Attorney, Agent, or Firm*—Cushman, Darby & Cushman

[57] ABSTRACT

A fuel supply system comprising a transverse partition wall upstream of a throttle valve and having at least one air intake opening therethrough, a spring-loaded metering rotor thereabove which has at least one rotary blade for controlling the opening area of the air intake opening and at least one movable wall upon which is exerted the intake air pressure, the partition wall having at least one stationary radial wall, whereby the stationary and movable walls define a pressure chamber which is variable in volume and into which is introduced the pressure downstream of the transverse partition wall, the pressures upstream and downstream of the transverse wall acting on the opposite surfaces of the movable partition wall so that the rotor is caused to rotate in the direction in which the opening area of the air intake opening is increased and the rotation of the metering rotor is stopped at an angular position at which the force of the bias spring is in equilibrium with the force rotating the metering rotor. Thus the angle of rotation of the metering rotor is in proportion to the flow rate of the intake air. A fuel metering valve has a spool formed integral with a shaft of the metering rotor and meters the fuel in proportion to the angle of rotation of the spool so that the air-fuel ratio can be maintained constant.

5 Claims, 6 Drawing Figures

FUEL SUPPLY SYSTEM FOR INTERNAL COMBUSTION ENGINE

BACKGROUND OF THE INVENTION

The present invention relates to a fuel supply system for an internal combustion engine of the type in which the fuel is metered in proportion to the flow rate of the intake air.

In the prior art fuel supply system of the type described, the flow rate of the intake air is converted into a mechanical displacement in response to which the opening area of a fuel metering slit is varied, whereby the fuel is metered in proportion to the flow rate of the intake air. However, the system for measuring the flow rate of the intake air (to be referred to as "the air metering system" in this specification for brevity) and the fuel metering system are interconnected with each other through a mechanical coupling, a lever or a linkage. As a result, the air-fuel ratio varies due to play between the component parts of the coupling means, their deflections, wear and deformations. In addition the prior art fuel system is disadvantageous in that there must be provided a relatively large space for housing such coupling means so that the fuel supply system itself becomes large in size.

SUMMARY OF THE INVENTION

In view of the above, the primary object of the present invention is to provide a fuel supply system for an internal combustion engine which can substantially eliminate the errors in metering the fuel caused by the use of a coupling means for operatively coupling between an air flow rate measuring system and a fuel metering system and which can be made very compact in size. According to the present invention there is provided a fuel supply system for an internal combustion engine comprising; a supporting barrel provided with at least one stationary partition wall and at least one air intake opening; a metering rotor having a rotary shaft mounted for rotation on said supporting barrel, at least one rotary blade carried by said rotary shaft for varying the opening area of said air intake opening in response to the angle of rotation of said rotary shaft, and at least one movable partition wall carried by said rotary shaft to move toward or away from said stationary partition wall; means which cooperates with said stationary and movable partition walls so as to define a pressure chamber whose volume is variable; means for transmitting the pressure downstream of said air intake opening into said pressure chamber; and a fuel metering system having a cylinder, a spool which is coaxial and rotatable in unison with said rotary shaft and rotatably fitted into said cylinder, and a fuel metering slit which is formed in the interface between said cylinder and said spool and whose opening area varies in response to the angle of rotation of said spool relative to said cylinder.

DESCRIPTION OF THE PREFERRED EMBODIMENT

Figure 1:
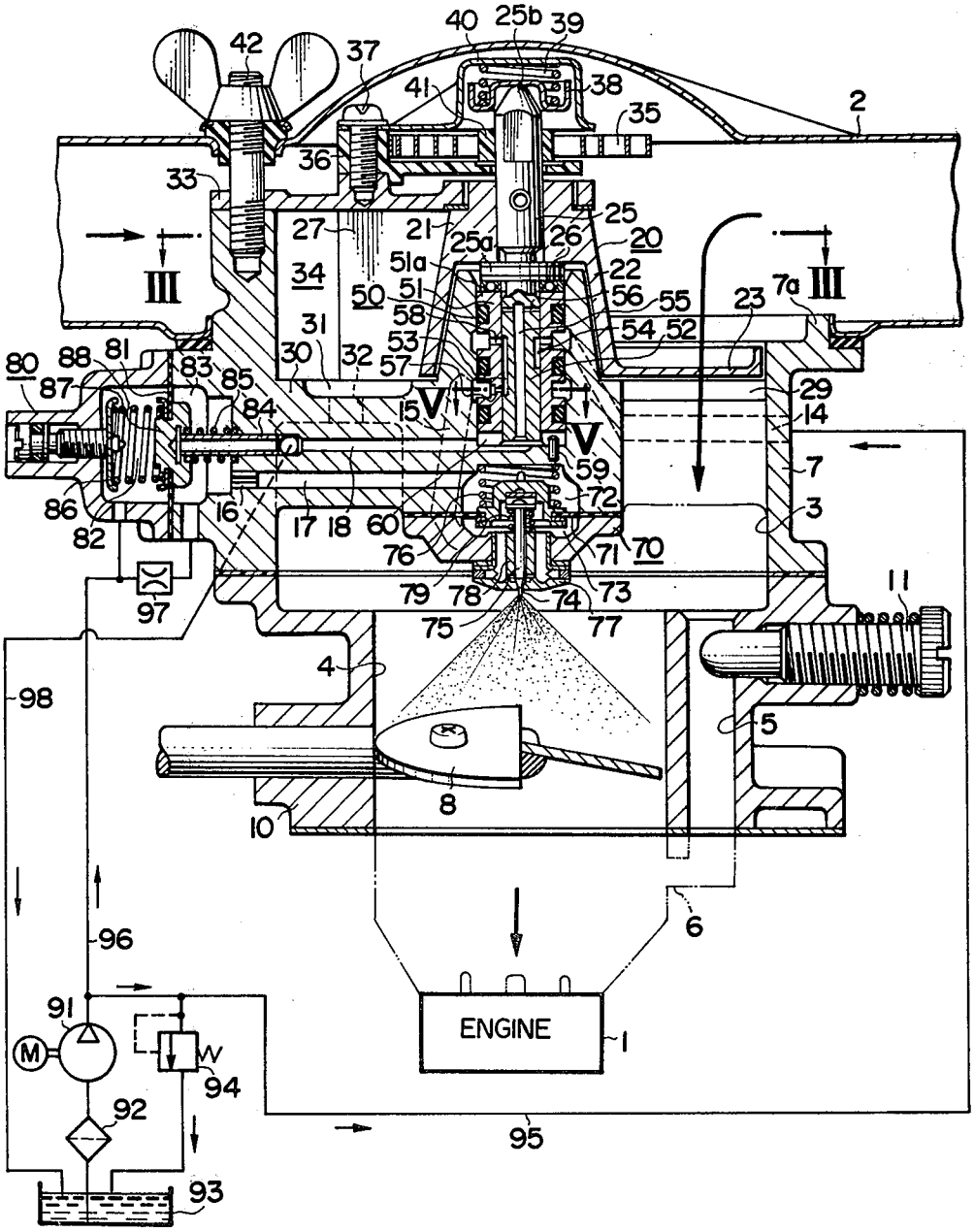
FIG. 1 is a longitudinal sectional view of a preferred embodiment of a fuel supply system in accordance with the present invention; that is, a sectional view taken along the line I—I of FIG. 3.

Referring to FIGS. 1 through 4, an engine 1 is of the multi-cylinder spark-ignition type. The combustion air is charged into the engine 1 through an air cleaner 2 (See FIG. 1, the filter element not shown), intake passages 3 and 4, an auxiliary intake passage 5 and an intake manifold 6 (schematically indicated by two-dot chain lines).

The intake passage 3 is defined in a barrel 7 upon which are mounted a fuel metering mechanism and a fuel injection valve. The intake passage 4 and the auxiliary intake passage 5 are defined in a throttle barrel 10 on which is mounted a throttle valve 8.

The throttle valve 8 is of the conventional butterfly type and comprises a valve plate and a pivot pin for pivoting the valve plate. The angular position or the degree of opening of the throttle valve 8 is controlled in response to the depression of an acceleration pedal (not shown). The auxiliary intake passage 5 is so defined as to bypass the throttle valve 8, and an idle adjusting screw 11 is partially extended into the auxiliary intake passage 5.

Figure 3:
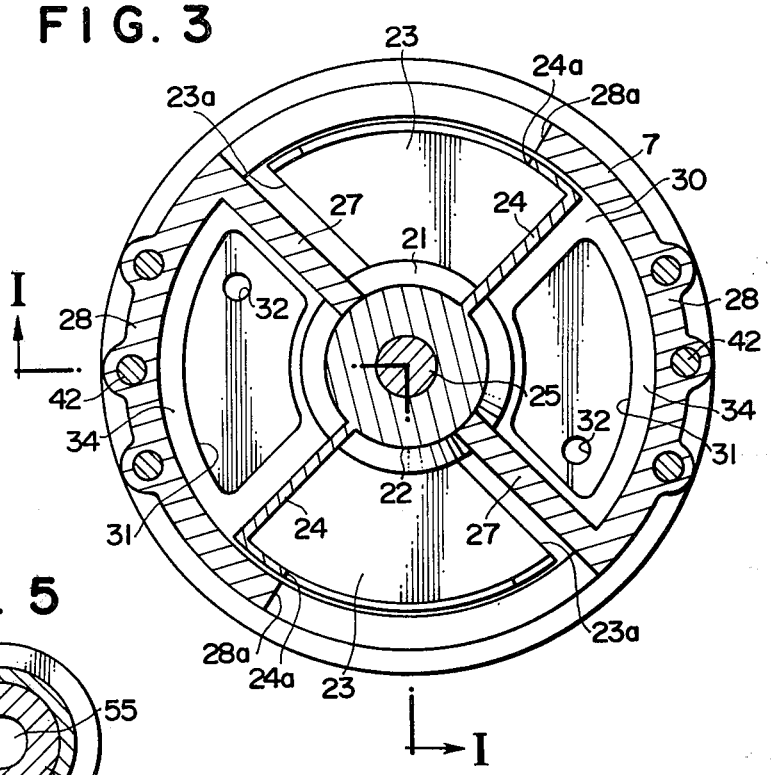
FIG. 3 is a sectional view taken along the line III—III of FIG. 1.

As shown in FIG. 1, the barrel 7 integrally carries an air metering system 20, a fuel metering system 50, and a fuel injection valve 70 in the order named from the top. The air metering system 20 includes a metering rotor 21 mounted for rotation on the barrel 7. As best shown in FIG. 3, the metering rotor 21 has a frustoconical boss 22, two quarter-round rotary blades 23, two movable partition walls 24 and a shaft 25.

The shaft 25 is press fitted into the boss 22 or splined or connected with a pin or the like to the boss 22 in such a way that there exists no relative circumferential displacement between them. The boss 22, the rotary blades 23 and the movable partition walls 24 are integrally made of a light metal alloy in such a way that the center of gravity of this integral unit concides with the axis of the shaft 25. One straight edge 23*a* of each of the rotary blades 23 is in the form of a sharp knife edge. The movable partition wall 24 is extended perpendicular to the rotary blade 23.

The flange 25*a* of the shaft 25 is supported through a thrust bearing 26 on the barrel 7 at the center thereof so that the smooth rotation of the shaft 25 is ensured.

The barrel 7 has radial stational walls 27 and arcuate outer walls 28 contiguous with the radial walls 27. As the movable wall 24 is rotated, its outer vertical edge makes arcuate movement with a constant small clearance from the corresponding outer wall 28. The barrel 7 has a bottom or partition wall 30 having two segmental air intake openings 29 and recesses 31 formed with throttle holes 32, respectively.

A cap 33 is bolted on the radial and arcuate outer walls 27 and 28 so that pressure chambers 34 are defined.

A coiled spring 35 is disposed in a spring holder 36 which in turn is mounted on the cap 33 with bolts 37 and the inner end of the coiled spring 35 is securely fastened to the shaft 25 through a boss 41 so that the shaft 25 is normally biased to rotate in the counterclockwise direction in FIG. 3. A coiled compression spring 39 is loaded between a dish-shaped holder 38 for holding the semi-spherical upper end 25*b* of the shaft 25 and an outer spring retainer or holder 40 which in turn is securely mounted on the cap 33 with bolts 37, so that the shaft 25 is always urged downward.

Figure 2:
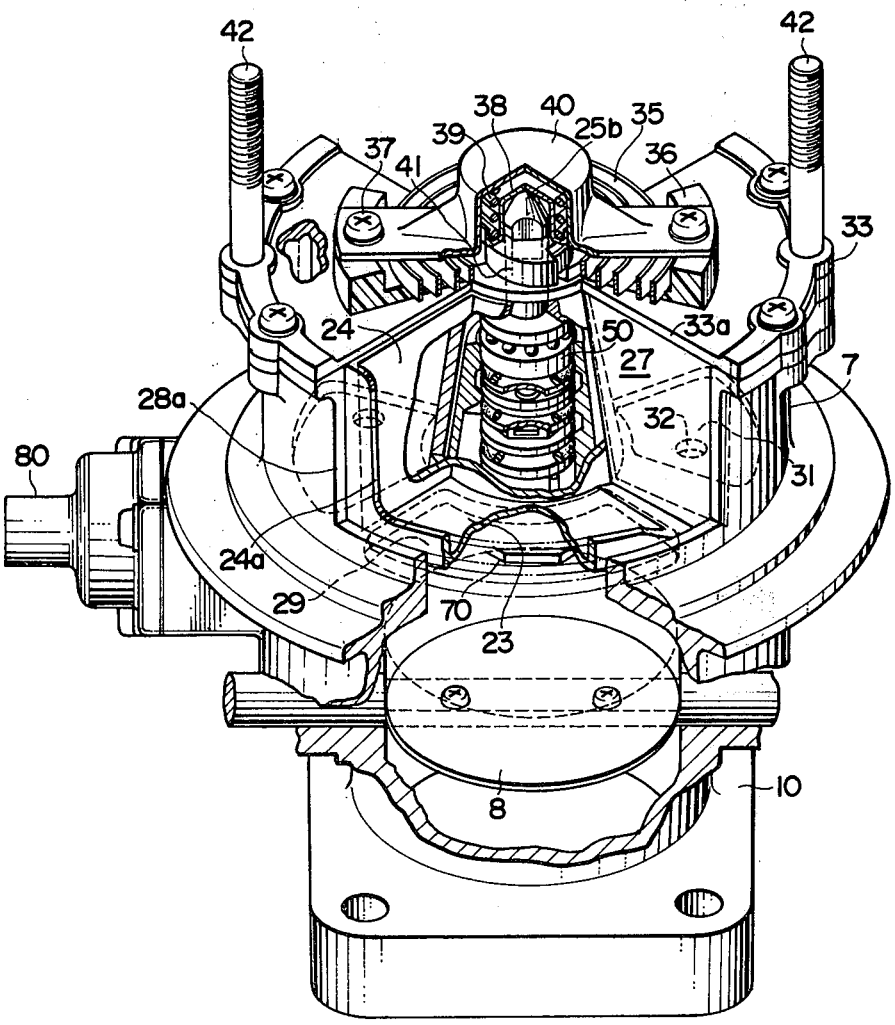
FIG. 2 is a perspective view, partly broken away, thereof.

The air cleaner 2 is fitted over the flange 7*a* of the barrel 7 and securely fastened thereto with stud bolts 42. The barrel 7 is so constructed that its upper portion is located in the air cleaner 2. As best shown in FIG. 2, the movable partition walls 24, the arcuate outer walls 28 and the cap 33 are partially cut off at 24*a*, 28*a* and 33*a* so that the air passages are defined.

The fuel metering system 50 is so designed and constructed as to meter the fuel in response to the angular position (the angle of rotation) of the shaft 25 of the air metering system 20. It comprises a cylinder 51 liquid-tightly fitted into an axial bore of the barrel 7 through three O rings and a spool 52 which is an extension of the shaft 25 and is rotatably fitted into the cylinder 51 with a clearance of a few microns. The spool 52 is formed in its cylindrical surface with an arcuate recess 53 and a circumferential recess 54 contiguous with the recess 53. The spool 52 is further formed with an axial hole 55, a radial hole 56 intersecting the axial hole 55 at right angles and a circumferential groove communicated with the radial hole 56 so that the fuel in the space or clearance between the cylinder 51 and the spool 52 is drained as will be described in detail below.

Figure 5:
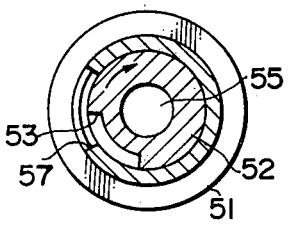
FIG. 5 is a sectional view of a cylinder and a spool taken along the line V—V of FIG. 1.
Figure 4:
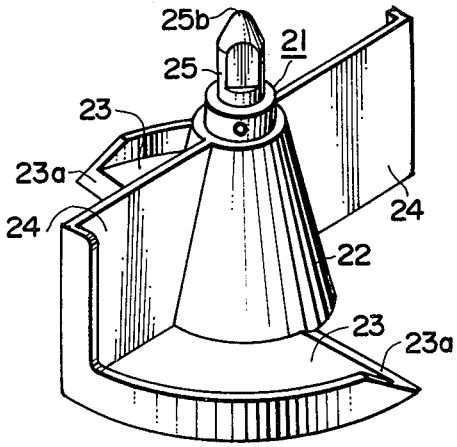
FIG. 4 is a perspective view of a metering rotor of the fuel supply system shown in FIG. 1.

As best shown in FIG. 5, the cylinder 51 is formed with an arcuate circumferential slit 57 in its inner surface and a plurality of radial fuel passages 58 in communication with the circumferential recess 54 of the spool 52. The cylinder 51 is further provided in its lower end with a radial groove 60 which cooperates with a pin 59 so as to set the circumferential angular position of the cylinder 51. The bearing 26 is interposed between the flange 25*a* of the shaft 25 and the upper end 51*a* of the cylinder 51.

As the spool 52 rotates, the overlapping area between the slit 57 of the cylinder 51 and the arcuate recess 53 of the spool 52 varies, whereby the fuel is metered.

The fuel injection valve 70 injects toward the throttle valve 8 the fuel metered by the fuel metering system 50. It has a back pressure chamber 72 and a fuel chamber 73 separated from each other by a diaphragm 71. A needle 75 is extended from the diaphragm 71 through the fuel chamber 73 into a fuel injection nozzle 74 to control the opening of the nozzle 74 and a small compression coil 79 is loaded in the fuel chamber 73 so as to normally bias the needle 75 toward the diaphragm 71. A coiled compression spring 76 is loaded in the back pressure chamber 72 so as to normally bias the diaphragm 71 and hence the needle 75 downward.

The nozzle 74 is formed in a nozzle body 77 which is also formed with a cylinder 78 which serves to guide the slidable movement of the needle 75 for opening and closing the nozzle 74. The back pressure chamber 72 is defined within the barrel 7. The fuel injection valve 70 is assembled integral with the fuel metering system 50 at its bottom.

The fuel supply system in accordance with the present invention further includes a differential pressure regulator 80 in order to apply the pressure of a predetermined magnitude to the back pressure chamber 72 of the fuel injection valve 70. The differential pressure regulator 80 has a back pressure chamber 82 and a predetermined pressure chamber 83 which are separated from each other by a diaphragm 81. A coiled spring 85 is loaded in the predetermined pressure chamber 83 so as to bias the diaphragm 81 toward the back pressure chamber 82. A compression spring 87 is loaded in the back pressure chamber 82, so as to bias the diaphragm 81 toward the predetermined pressure chamber 83. One end of the compression spring 87 is retained by a spring retainer 86 whose position is adjustable so that the force of the compression spring 87 is also adjustable. The diaphragm 81 is provided with a valve body 88 which opens or closes the open end of a fuel return pipe 84 disposed to open into the pressure chamber 83.

A fuel feed system comprises in general a motor-driven fuel pump 91, a fuel filter 92, a fuel tank 93 and a relief valve 94, whereby the fuel under a predetermined pressure is supplied through a fuel line 95 and a fuel passage 14 (indicated by the broken lines in FIG. 1) in the barrel 7 to the fuel passage 58 in the fuel metering system 50. The fuel under pressure is also supplied through a fuel line 96 to the back pressure chamber 82 in the differential pressure regulator 80 and also to the predetermined pressure chamber 83 after the pressure is reduced through a fixed restriction 97.

Within the barrel 7, the fuel metering system 50 is communicated with the fuel chamber 73 of the fuel injection valve 70 through a fuel passage 15 indicated by the broken lines in FIG. 1. The predetermined pressure chamber 83 of the differential pressure regulator 80 is communicated with the back pressure chamber 72 of the fuel injection valve 70 through a fixed restriction 16 and a fuel passage 17. The fuel return pipe 84 of the differential pressure regulator 80 is communicated with the axial hole 55 of the spool 52 through a fuel passage 18 and also with the fuel tank 93 through a fuel return line 98.

In operation, the combustion air is charged into the engine 1 through the air cleaner, the air intake openings 29 of the air metering system 20, the intake air passages 3 and 4 and the intake manifold 6 as indicated by the arrow in FIG. 1. As the air passes through the air intake openings 29, the pressure difference $\Delta P$ results across them and the pressure (negative) in the intake passage 3 downstream of the air intake openings 29 is introduced through the throttle hole 32 into the pressure chamber 34. As a result, the movable radial walls 24 of the metering rotor 21 is imparted with such torques that the metering rotor 21 is rotated in the clockwise direction in FIG. 3; that is, the rotary blades 23 are caused to rotate in the plane substantially perpendicular to the flows of the air passing through the air intake openings 29.

Since the center of gravity of the metering rotor 21 is at the axis of the shaft 25, the pressure difference $\Delta P$ is determined only by the force of the coiled spring 35 (the torque T) which in turn is maintained at a constant value regardless of the angle of rotation of the metering rotor 21. Therefore the pressure difference $\Delta P$ is given by $$\Delta P = T/(n.S.r) = \text{constant}$$

where n: the number of movable walls 24;

S: the area of each wall 24 upon which acts the pressure difference $\Delta P$; and r: the radius from the axis of the shaft 25 to the center on the wall 24 of the pressure difference $\Delta P$.

It follows therefore that the area of the opening which is varied by the rotation of the rotary blade 23 is given by $$A = \frac{Q}{\sqrt{(Q/R) \cdot \Delta P}} = k_1 \cdot Q$$

where

R: the density of the air;

Q: the flow rate of the intake air; and $k_1$: constant of proportionality.

It is seen that the area A of opening is dependent only on the flow rate of the air.

Therefore, when the angle $\theta$ of rotation of the metering rotor 21 is correlated with the area A to make a suitable functional relationship therebetween, the following relation is established $$\theta = K_2 . f(Q)$$

where $K_2$: a constant of proportionality. This means that the angle $\theta$ of rotation of the metering rotor 21 varies in a predetermined functional relationship with the flow rate Q of intake air.

As a result, the overlapping area Af (that is, the fuel passage area) between the arcuate recess 53 of the spool 52 and the slit 57 of the cylinder 51 (See FIG. 5) changes in accordance with the flow rate Q of the intake air.

Meanwhile the fuel whose pressure is maintained at Ps by the fuel pump 91 and the relief valve 94 is supplied to the arcuate recess 53 of the spool through the fuel line 95, the fuel passages 14 and 58 and the circumferential recess 54 and to the back pressure chamber 82 of the differential pressure regulator 80 through the fuel line 96.

The force of the spring 85 of the differential pressure regulator 80 is set to a value greater than that of the spring 87 by $\Delta F$, and the following relationship is established.

$$Ps - Pd = \Delta F / D_1 = \Delta P_1 = \text{constant}$$

where $D_1$: the effective pressure receiving area of the diaphragm 81; and $P_d$: the pressure in the predetermined pressure chamber 83.

Therefore it follows that the pressure $P_d$ which is lower than $P_s$ by a predetermined value $\Delta P_1$, is applied to the back pressure chamber 72 of the fuel injection valve 70 through the restriction 16 and the passage 17.

The spring 76 in the back pressure chamber 72 of the fuel injection valve 70 is greater than that of the spring 79 in the fuel chamber 73 by a predetermined value of $\Delta Fs$. Then the following relationship is established:

$$Pd - Pn = (-\Delta Fs)/D_2 = -\Delta P_2 = \text{constant}$$

where

Pn: the pressure in the fuel chamber 73; and $D_2$: the effective pressure receiving area of the diaphramg 71.

This means that the pressure Pn which is higher than the pressure Pd by a predetermined value of $\Delta P_2$ is applied to the slit 57 and the passage 15. Therefore when $\Delta P_1 > \Delta P_2$ the following relationship is held:

$$Ps - Pn = \Delta P_1 - P_2 = \Delta P_f = \text{constant.}$$

That is, a predetermined pressure difference $\Delta Pf$ occurs across the slit 57. Therefore the following correlationship can be held:

$$Q_f \propto A_f \sqrt{(2/R_f)\, \Delta P_f} = K_3 \cdot A_f$$

where $Q_f$: the flow rate of the fuel passing through the slit 57; and $K_3$: a constant of proportionality.

This means that the flow rate Qf of the fuel is dependent only on the opening area $A_f$ of the slit 57. Since the opening area $A_f$ varies in dependence on the angle $\theta$ of rotation of the spool 52, when a suitable functional relationship is set between the angle $\theta$ and the area $A_f$, the following relationship is held:

$$\theta = K_4 . f(Q_f)$$

where $K_4$: a constant of proportionality.

It follows therefore that $$[f(Q)/f(Q_f)] = K_2/K_4 = \text{constant.}$$

Thus the fuel is injected through the nozzle 74 of the fuel injection valve 70 at the flow rate of $Q_f$ which is a predetermined ratio relative to the flow rate Q of the intake air, whereby air-fuel mixture at a constant air-fuel ratio is supplied to the engine.

As described previously, the shaft 25 of the air metering system 20 and the spool 52 of the fuel metering system are formed as an integral unit. As a result, opposed to a shaft and a spool which are connected through a coupling or a lever, the fuel supply system of the present invention can be very compact in size. In addition, the adverse effects caused by the play and deflection of the coupling can be eliminated. As a consequence, the area of opening of the slit 57 can be accurately conrolled by the metering rotor 21 which detects the flow rate of intake air, whereby the fuel can be metered with a higher degree of accuracy.

Since the spring 39 is loaded, the axial displacement of the shaft 25 is limited so that the vibration of the metering rotor 21 due to the vibration of the engine 1 itself or by the backfires can be prevented and consequently the adverse effects on the metering of the fuel can be avoided.

The forces which tend to shift the metering rotor 21 in the direction perpendicular to the shaft 25 are received by the rotating sliding interface between the spool 52 and the cylinder 51 both of which are machined with a higher degree of dimensional accuracies and are lubricated by the fuel so that no frictional force is produced which adversely affects the rotation of the shaft 25.

The surfaces of the flange 25*a* of the shaft 25 and the top end of the cylinder 51 which are made into contact with the bearing 26 are finished by fit lapping the both surfaces under intimate contact with each other so that the squareness of these surfaces with respect to the axis of the shaft 25 can be attained within the tolerance of less than one micron. When a plurality of balls of the bearing 26 are disposed circumferentially, the overall height of the balls becomes the square root mean of the heights or diameters of individual balls. The overall height therefore can be maintained within the tolerance of less than one micron by the use of balls of the conventional ball bearings.

Thus, the so-called scuffing of the shaft 25 due to its wobbling can be substantially eliminated so that the rapture of oil films can be avoided. As a consequence, the very smooth rotation of the metering rotor 21 can be ensured.

After lubricating the sliding or rubbing surfaces of the cylinder 51 and spool 52, the fuel is returned to the fuel tank 93 through the circumferential groove, the radial hole 56 and the axial hole 55 of the spool 52, the fuel passage 18 and the fuel line 98 so that the undesired addition of the fuel, which is used as a lubricant, to the metered fuel can be avoided and consequently a desired air-fuel ratio can be maintained.

The air is arranged to flow from the air cleaner 2 into the intake openings 29 of the air metering system 20 through the cut-off portions of the stationary arcuate outer walls 28. As a result, the spacing between the cap 33 and the top wall of the air cleaner 2 can be made very close and consequently the length from the lower end of the throttle-valve barrel 10 to the top of the air cleaner 2 can be shortened. As a result, the fuel supply system can be made further compact in size.

Figure 6:
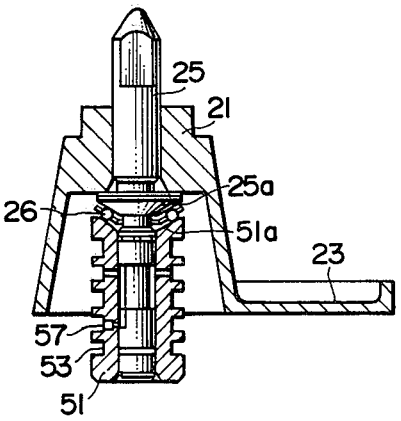
FIG. 6 is a longitudinal sectional view of a modified supporting member for supporting the metering rotor shown in FIG. 4.

The bearing 26 shown in FIG. 1 is of the conventional flat type, but it is to be understood that instead an angular bearing as shown in FIG. 6 can be also used. In this case the flange 25*a* of the shaft 25 and the upper end 51*a* of the cylinder 51 are so machined as to have the conical bearing surfaces. With the angular bearing, the wobbling of the shaft 25 can be further eliminated.

In summary, according to the present invention, the rotation of the metering rotor 21 of the air metering system 20 can be accurately transmitted to the fuel metering system 50 because there exists no additional parts operatively connecting therebetween which tend to produce error due to deflections and plays of the parts, so that the very accurate metering of fuel can be ensured. In addition, the fuel supply system can be made very compact in size.

Furthermore although the shafts of the air and fuel metering systems are made integral while the so-called scuffing of the shaft can be completely eliminated so that the very smooth rotation of the metering rotor 21 can be ensured.

What is claimed is:

1. A fuel supply system for an internal combustion engine comprising: a supporting barrel provided with
- a transverse wall,
- a pair of stationary partition walls disposed substantially perpendicularly to said transverse wall and in diametrically symmetrical relationship with each other about the axis of said barrel and
- a pair of air intake openings formed through said transverse wall at diametrically symmetric positions with respect to the axis of said barrel; a metering rotor having
- a rotary shaft mounted for rotation on said supporting barrel,
- a pair of rotary blades disposed substantially in diametrically symmetrical relationship with each other about the axis of said rotary shaft, each being in the form of a sector and carried by said rotary shaft for varying the opening area of each of said air intake openings in response to the angle of rotation of said rotary shaft, and
- a pair of movable partition walls disposed substantially perpendicularly to said rotary blades and in diametrically symmetrical relationship with each other about the axis of said rotary shaft, each being carried by said rotary shaft to move toward or away from each of said stationary partition walls;
- means which cooperates with said transverse walls, said stationary partition walls and said movable partition walls so as to define pressure chambers whose volume is variable;
- means for transmitting the pressure downstream of said air intake openings into said pressure chambers; a fuel metering system having
- a cylinder,
- a spool which is coaxial and rotatable in unison with said rotary shaft and rotatably fitted into said cylinder, and
- a fuel metering slit which is formed in the interface between said cylinder and said spool and whose opening area varies in response to the angle of rotation of said spool relative to said cylinder; and
- a fuel injection valve securely mounted on said supporting barrel coaxially with said rotary shaft for injecting the fuel metered through said fuel metering slit into an intake passage downstream of said air intake openings.

2. A fuel supply system as set forth in claim 1, wherein said pressure transmitting means comprises a hole formed through a portion of said transverse wall defining each of said pressure chambers.

3. A fuel supply system for an internal combustion engine comprising
- a supporting barrel provided with an air intake passage disposed upstream of a throttle valve, said supporting barrel having
  - a circular bottom wall extending across said air intake passage transversely thereof,
  - a supporting member circular in cross section extending perpendicular to and coaxially of said circular bottom wall, two partially cylindrical outer walls which extend to the upstream direction from the periphery of said circular bottom wall in diametrically symmetrical relationship with each other about the axis of said circular bottom wall,
  - two stationary radial partition walls extending to the upstream direction from said circular bottom wall, the outer edge of said each stationary partition wall being connected to one of the side edges of said each outer wall, an air intake opening which is substantially in the form of a sector and is formed through each of segmental portions of said circular bottom wall, the outer edge of each of said segmental portions being in line with the extension of said arcuate outer walls and lying between them, and
  - a throttle hole which is formed through each of the portions of said circular bottom wall enclosed by said arcuate outer wall and said radial stationary partition wall and adjacent to said radial stationary partition wall;
- a metering rotor having
  - a rotary shaft which extends through said supporting member coaxially thereof, has an upper end substantially in the form of a semisphere and abutted against a dish-shaped retainer which in turn is axially loaded with a spring, and has a flange which is axially spaced apart from said semispherical upper end of said rotary shaft and is supported by a thrust bearing which in turn is mounted on said supporting member, a boss securely fixed to said rotary shaft, a rotary blade which is formed integral with said boss substantially in the form of a sector so as to vary the opening area of each of said air intake openings in response to the angle of rotation of said rotary shaft, and a movable partition wall which is formed integral with said boss and said rotary blade and extending radially of said rotary shaft toward said outer wall, a cap fixed to the upper ends of said outer walls and said stationary partition walls, thereby defining pressure chambers together with said circular bottom wall, said outer walls and said stationary partition walls;

a spring for biasing said metering rotor in the direction in which said air intake openings are closed;

a fuel metering system having a cylinder disposed within said supporting member coaxially thereof and having one end which supports said thrust bearing, a spool which is formed integral with and extends from said rotary shaft coaxially thereof and which is rotatably fitted into said cylinder, and a fuel metering slit formed in the interface between said cylinder and said spool, the opening area of said fuel metering slit being varied in response to the angle of rotation of said spool; and a fuel injection valve securely mounted on said supporting barrel for injecting into an intake passage downstream of said bottom wall the fuel metered through said fuel metering slit.

4. A fuel supply system for an internal combustion engine comprising:

a supporting barrel provided with at least one stationary partition wall and at least one air intake opening;

a metering rotor having a rotary shaft mounted for rotation on said supporting barrel and having a free end substantially in the form of a hemisphere, a dish-shaped retainer, said hemispherical end abutting against said retainer, a spring loading said retainer in the axial direction, at least one rotary blade carried by said rotary shaft for varying the opening area of said air intake opening in response to the angle of rotation of said rotary shaft, and at least one movable partition wall carried by said rotary shaft to move toward or away from said stationary partition wall;

means which cooperates with said stationary and movable partition walls so as to define a pressure chamber whose volume is variable;

means for transmitting the pressure downstream of said air intake opening into said pressure chamber; and a fuel metering system having a cylinder, a spool, which is formed integral with and is coaxial and rotatable in unison with said rotary shaft and rotatably fitted into said cylinder, and a fuel metering slit which is formed in the interface between said cylinder and said spool and whose opening area varies in response to the angle of rotation of said spool relative to said cylinder, said rotary shaft has a flange formed integral therewith and located adjacent to said spool, said flange of said rotary shaft being supported by a thrust bearing mounted on the upper end of said cylinder.

5. A fuel supply system as set forth in claim 1 or 4 wherein said rotary shaft and said spool are supported vertically.

* * * * *